US009840992B2

(12) United States Patent
Duncan et al.

(10) Patent No.: US 9,840,992 B2
(45) Date of Patent: Dec. 12, 2017

(54) FUEL INJECTOR SYSTEM AND METHOD FOR MAKING AIR-FILLED DIESEL DROPLETS

(71) Applicant: Elwha LLC, Bellevue, WA (US)

(72) Inventors: William D. Duncan, Mill Creek, WA (US); Roderick A. Hyde, Redmond, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 123 days.

(21) Appl. No.: 14/641,096

(22) Filed: Mar. 6, 2015

(65) Prior Publication Data

US 2016/0258399 A1 Sep. 8, 2016

(51) Int. Cl.

| | |
|---|---|
| ***F02M 61/18*** | (2006.01) |
| ***F02M 43/04*** | (2006.01) |
| ***F02M 51/06*** | (2006.01) |

(52) U.S. Cl.

CPC ..... *F02M 43/04* (2013.01); *F02M 51/0603* (2013.01); *F02M 61/18* (2013.01)

(58) Field of Classification Search

CPC .... F02M 43/04; F02M 37/0023; F02M 61/18; F02M 51/0603; F02M 69/046; F02M 21/02; F02M 21/0203; F02M 21/0248; F02M 21/0254; F02M 21/0287; F02M 69/08; F02M 67/06; F02D 21/02; F02D 21/0203; F02D 21/0248; F02D 21/0254; F02D 21/0287; F02D 41/0025; F02D 41/0027; F02D 41/3094

USPC ..... 123/431, 525, 27 GE, 531, 575, 490

See application file for complete search history.

(56) References Cited

U.S. PATENT DOCUMENTS

| | | | | |
|---|---|---|---|---|
| 1,938,497 | A | 12/1933 | Pogue | |
| 1,997,497 | A | 4/1935 | Pogue | |
| 2,026,798 | A | 1/1936 | Pogue | |
| 3,722,837 | A | 3/1973 | Dapprich | |
| 4,592,329 | A | 6/1986 | Yunick | |
| 4,763,481 | A * | 8/1988 | Cannon | F23D 11/12 60/737 |
| 5,400,746 | A | 3/1995 | Susa et al. | |
| 5,794,860 | A * | 8/1998 | Neumann | F02M 51/0653 239/585.3 |
| 6,328,231 | B1 * | 12/2001 | Ording | F02M 51/0625 239/585.1 |
| 6,336,598 | B1 * | 1/2002 | Touchette | F02D 19/10 239/408 |
| 6,508,418 | B1 * | 1/2003 | Fochtman | F02M 51/0625 123/472 |
| 6,799,733 | B1 * | 10/2004 | Pace | F02M 51/0671 239/533.12 |
| 7,373,931 | B2 * | 5/2008 | Lennox | F02D 19/0605 123/27 GE |

(Continued)

OTHER PUBLICATIONS

Oda et al., "Influence of Micro-Bubbles within Ejected Liquid on Behavior of Cavitating Flow inside Nozzle Hole and Liquid Jet Atomization" ILASS Europe Meeting 2007, 6 pages.

*Primary Examiner* — Hai Huynh
(74) *Attorney, Agent, or Firm* — Foley & Lardner LLP

(57) ABSTRACT

A fuel injector for an engine includes a connection to a fuel source, a nozzle which provides an outlet from the fuel injector, a fuel path from the fuel source to the nozzle, a valve between the fuel path and the nozzle, and a gas injection mechanism configured to insert a gas core into the fuel.

34 Claims, 7 Drawing Sheets

(56) References Cited

U.S. PATENT DOCUMENTS

| | | | | |
|---|---|---|---|---|
| 7,891,579 | B2 * | 2/2011 | Mashida | F02D 19/10 239/533.11 |
| 8,322,325 | B2 * | 12/2012 | Rogak | F02D 19/0647 123/304 |
| 8,820,295 | B2 * | 9/2014 | Coldren | F02M 63/0045 123/304 |
| 9,228,505 | B2 * | 1/2016 | Mittal | F02D 19/06 |
| 9,366,195 | B2 * | 6/2016 | Wager | F02D 19/0647 |
| 9,376,992 | B2 * | 6/2016 | Brown | F02M 43/04 |
| 2004/0234912 | A1 * | 11/2004 | Sarv | F23D 1/00 431/183 |
| 2006/0086825 | A1 * | 4/2006 | Date | F02M 43/04 239/408 |
| 2008/0011887 | A1 * | 1/2008 | Parish | F02M 51/0682 239/585.5 |
| 2009/0020631 | A1 * | 1/2009 | Mashida | F02D 19/10 239/533.3 |
| 2010/0077650 | A1 | 4/2010 | Shiode et al. | |
| 2011/0108631 | A1 * | 5/2011 | Mumford | F02M 21/0263 239/5 |
| 2012/0000996 | A1 | 1/2012 | Kobayashi | |
| 2012/0285417 | A1 * | 11/2012 | Kim | F02D 19/0684 123/299 |
| 2014/0123948 | A1 * | 5/2014 | Mittal | F02M 45/086 123/456 |
| 2014/0196687 | A1 * | 7/2014 | Coldren | F02D 19/0642 123/299 |
| 2016/0273502 | A1 * | 9/2016 | Mulye | F02M 61/1813 |

* cited by examiner

FUEL INJECTOR SYSTEM AND METHOD FOR MAKING AIR-FILLED DIESEL DROPLETS

BACKGROUND

Internal combustion engines combust a mixture of fuel and gasses in order to provide motive force to the engine which produces usable power for a variety of applications. Fuel injectors in the engine typically inject liquid fuel in a spray which enhances the evaporation or gasification of the fuel. Fuel which remains in liquid state and is combusted may produce increased levels of and/or different types of combustion byproducts which may be undesirable. For example, diesel fuel when combusted in a liquid state may cause the formation of soot and/or other harmful or undesirable combustion byproducts.

SUMMARY

One embodiment relates to a fuel injector for injecting fuel having a gas core. The fuel injector includes a connection to a fuel source, a nozzle which provides an outlet from the fuel injector, a fuel path from the fuel source to the nozzle, a valve between the fuel path and the nozzle, and a gas injection mechanism configured to insert a gas core into the fuel.

Another embodiment relates to a fuel injector for an engine. The fuel injector includes a connection to a fuel source, a nozzle which provides an outlet from the fuel injector, and a fuel path from the fuel source to the nozzle. A valve stem is shaped to engage with a valve seat to control the flow of fuel through the fuel path. An annulus within the valve stem is coupled to a gas source and configured to provide gas to a core of the fuel stream of the fuel in the fuel path flowing around the valve stem. The valve stem is coupled to a solenoid which positions the valve stem in relative to the valve seat.

Another embodiment relates to a fuel injector for an engine. The fuel injector includes a connection to a fuel source, a nozzle which provides an outlet from the fuel injector, and a fuel path from the fuel source to the nozzle. The fuel injector also includes a valve stem shaped to engage with a valve seat to control the flow of fuel through the fuel path, wherein the valve stem is coupled to a solenoid which positions the valve stem in relative to the valve seat. The fuel injector further includes a piezoelectric driver configured to inject a gas from a gas source into a fuel stream.

Another embodiment relates to a fuel injector system for an engine. The system includes a fuel source, a heating system configured to heat the fuel from the fuel source, and a fuel injector which receives the heated fuel from the heating system and is configured to inject the fuel. The fuel injected from the fuel injector is in a gas state. The system may further include a bolus chamber configured to receive fuel from the fuel source, a heating element configured to heat fuel contained in the bolus chamber, a heat exchanger configured to heat fuel contained in the bolus chamber using heat scavenged from engine exhaust, and/or a control circuit configured to control the heating of the fuel in the bolus chamber and the movement of fuel into the bolus chamber and out of the bolus chamber to the fuel injector.

Another embodiment relates to a fuel injector for an engine. The fuel injector includes a connection to a fuel source, a nozzle which provides an outlet from the fuel injector, a fuel path from the fuel source to the nozzle, and a valve between the fuel path and the nozzle. The fuel injector further includes a system configured to enhance the breakup of injected fuel droplets by providing the fuel droplets with at least one of oscillations in shape, oscillations in spin, or a combination of oscillations in shape and oscillations in spin.

Another embodiment relates to a method for injecting fuel into an engine using a fuel injector. The method includes unseating a valve stem to allow fuel to flow from a fuel source around the valve stem and to a nozzle, providing a gas from an annulus of the fuel injector into a fuel stream within the fuel injector, and breaking up the fuel stream into droplets including gas cores.

Another embodiment relates to a method for injecting fuel into an engine using a fuel injector. The method includes receiving, into a reservoir of a piezoelectric driver, a gas from a gas source, actuating a piezoelectric element of the piezoelectric driver, and deforming a portion of the reservoir, using the piezoelectric element. Deforming a portion of the reservoir drives the gas from the reservoir through a nozzle and into a fuel stream passing through the fuel injector.

Another embodiment relates to a method for injecting fuel into an engine using a fuel injector. The method includes receiving fuel into a bolus chamber, heating the fuel in the bolus chamber using a heating system, providing the heated fuel to the fuel injector, and injecting the fuel. The fuel injected from the fuel injector is in a gas state.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
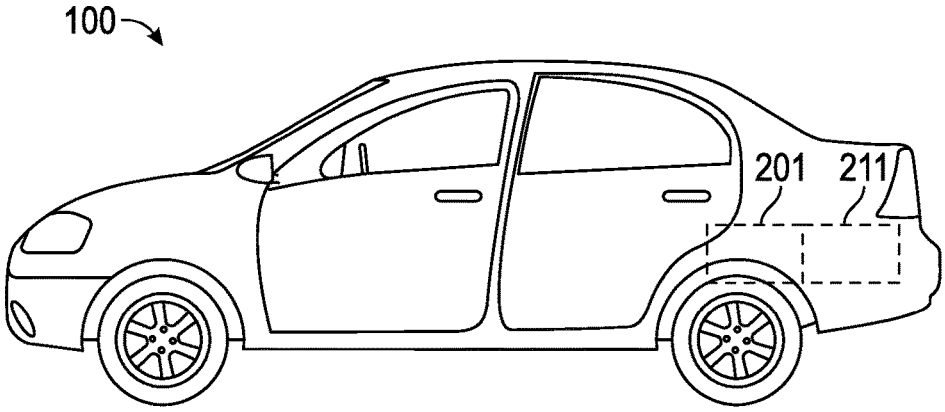
FIG. 1 is an illustration of a vehicle having a fuel injection system according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The embodiments described herein present systems and methods for improving combustion of fuels within an internal combustion engine by reducing or eliminating the combustion of fuel in liquid state and/or providing fuel internal gas. Referring to the FIGURES generally, fuel system 201 for vehicle 100 is illustrated according to various embodiments. Fuel system 201 may provide fuel to an engine of vehicle 100 such that the combustion of the fuel results in improved emissions (e.g., reduced emissions, cleaner emissions, reduced soot emissions, reduced particulate emissions, reduction in carbon dioxide emissions, reductions in other compounds in emissions, and/or otherwise more environmentally beneficial emissions). The fuel system may be used to deliver one or more fuels to one or more engines of vehicle 100. In one embodiment, fuel system 201 delivers diesel fuel to an internal combustion engine of vehicle 100. The fuel provided by fuel system 201 is combusted by the engine and due to the characteristics of fuel system 201 described herein may result in one or more improved emission qualities.

In one embodiment, fuel system 201 controls the injection of fuel into the engine such that a gas (e.g., air, oxygen, etc.) is inserted within a plurality of fuel droplets injected into the engine (e.g., into air intake manifold 215, into one or more cylinders 217, and/or into other combustion chambers or combustion chamber intakes). In an alternative embodiment, fuel system 201 pre-heats the fuel before it is injected into the engine. The fuel may enter air intake manifold 215 and/or one or more cylinders 217 as a gas. In some embodiments, liquid fuel does not enter the combustion chamber (e.g., cylinder 217) of the engine.

Referring to FIG. 1, vehicle 100 is illustrated according to one embodiment. Vehicle 100 may be any vehicle including an internal combustion or other engine 211 powered by the combustion of fuel. Engine 211 is provided with fuel by fuel system 201. In one embodiment, vehicle 100 is a road going vehicle with a diesel internal combustion engine 211. For example, vehicle 100 may be a car, truck, semi-truck, van, automobile, motorcycle, all-terrain vehicle, tricycle, or other vehicle. In some embodiments, vehicle 100 is one of other types of land based vehicles. For example, vehicle 100 may be a train or other vehicle. In alternative embodiments, vehicle 100 is a waterborne vehicle. For example, vehicle 100 may be a boat, personal watercraft, hovercraft, hydrofoil, or other watercraft. In further alternative embodiments, vehicle 100 is an airborne vehicle. For example, vehicle 100 may be a plane, helicopter, blimp, airship, or other aircraft.

In some embodiments, fuel system 201 is used in a non-vehicle application. For example, fuel system 201 may be used to deliver fuel to an engine powering a generator, an engine powering a machine other than a vehicle (e.g., a pump, a manufacturing device, or other machine), or other engine. In further embodiments, fuel system 201 may be included in a vehicle for powering an engine but the engine is used for a purpose other than directly providing a driving force to the vehicle. For example, the engine may drive a generator to produce electrical energy.

Figure 2:
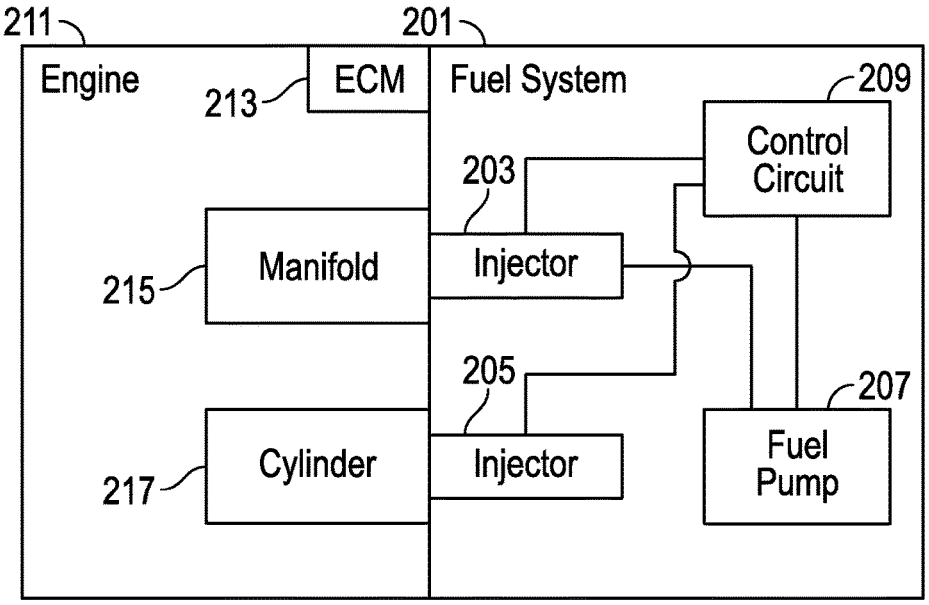
FIG. 2 is an illustration of a fuel injection system for providing a gas to a fuel stream according to one embodiment.

Referring now to FIG. 2, fuel system 201 is illustrated according to one embodiment. Fuel system 201 includes one or more fuel injectors 203 and/or one or more fuel injectors 205. Fuel injectors 203 are fuel injectors for delivering fuel (e.g., petrol or diesel fuel) into intake manifold 215 of engine 211. A single fuel injector 203 injects a stream of fuel into intake manifold 215 in some embodiments. In alternative embodiments, a plurality of fuel injectors 203 inject fuel into intake manifold 215 at one or more locations. A plurality of fuel injectors 203 may draw fuel from a common fuel rail or other source. Fuel injectors 205 are fuel injectors which deliver fuel into a combustion chamber (e.g., cylinder 217, combustion chamber of a Wankel engine, etc.) of engine 211. In some embodiments, fuel injectors 205 inject fuel into cylinders 217. One or a plurality of fuel injectors 205 may be used to provide fuel within cylinder 217 and/or another combustion chamber of engine 211. In some embodiments, a single fuel injector 205 is positioned to inject fuel into each cylinder 217 of engine 211. In alternative embodiments, a plurality of fuel injectors 205 are positioned to inject fuel into each cylinder 217.

In one embodiment, fuel system 201 includes only fuel injectors 203. Fuel injectors 205 are not included in fuel system 201. Fuel is delivered to engine 211 solely through intake manifold 215 and fuel injector(s) 203. Fuel is not delivered directly into a combustion chamber (e.g., cylinder 217) of engine 211. In an alternative embodiment, fuel system 201 includes only fuel injectors 205. Fuel injectors 203 are not included in fuel system 201. Fuel is delivered to engine 211 solely into cylinders 217 and through fuel injectors 205. Fuel is not delivered into intake manifold 215. In still further alternative embodiments, fuel system includes both fuel injectors 205 and fuel injector(s) 203. Fuel may be delivered to intake manifold and/or cylinder 217 selectively, simultaneously, or otherwise provided to engine 211 through a combination of fuel injectors 203 and fuel injectors 205.

Fuel injectors 203 and fuel injectors 205 may be any type of fuel injector suitable for providing fuel according to the characteristics of fuel system 201 as described herein. As described in greater detail with reference to FIGS. 3A-4, fuel injector 203 and/or fuel injector 205 may have one or more of a variety of configurations. In one embodiment, fuel injector 203 and/or fuel injector 205 are configured to insert a high pressure air-core into individual fuel droplets (e.g., diesel fuel droplets). Air and/or other gasses (e.g., oxygen, oxygen enriched air, nitrogen, nitrous oxide, and/or other gasses or combinations of gasses) may be inserted or injected into diesel fuel droplets by injectors 203 and/or 205.

In one embodiment, fuel injectors 203 and/or 205 use a nozzle within a nozzle to inject air or other gasses into diesel or other fuel droplets. This configuration is described in greater detail with reference to FIG. 3A. In other embodiments, fuel injectors 203 and/or 205 inject air or other gasses into fuel droplets using a piezoelectric or gas operated system. This configuration is described in greater detail with reference to FIG. 3B.

In still further embodiments, fuel injectors 203 and/or 205 inject air bubbles into a fuel stream enclosed in a conduit, then separate the stream into droplets in between the air bubbles. Fuel injectors 203 and/205 may inject the air bubbles during the breakup process of the fuel stream into droplets. The conduit may be a portion of fuel injector 203 and/or 205. The stream of fuel and air bubbles may be separated using one or more techniques such as operation of a valve of fuel injector 203 and/or 205. The breakup process of the fuel stream into droplets may occur as the result of the operation of a valve of fuel injector 203 and/or 205, a change in diameter of a conduit containing the fuel stream, injection of the fuel stream into a cavity (e.g., a combustion chamber or larger area of fuel injector 203 and/or 205), or other process or technique.

In some embodiments, fuel droplets and bubbles may be formed at high pressure and injected into a combustion chamber (e.g., cylinder 217) filled with high pressure air and/or other gasses. Cylinder 217 may be pressurized before the injection of fuel using one or more systems. Injectors 203 and/or 205 may introduce air or other gasses into the combustion chamber to pressurize the chamber prior to injecting fuel. The operation of cylinder 217 may also or alternatively serve to pressurize the combustion chamber. For example, cylinder 217 may begin a compression stroke portion of the combustion cycle prior to the injection of fuel by fuel injectors 203 and/or 205. Fuel may be injected during or after the compression stroke. In further embodiments, cylinder 217 or other combustion chamber may be filled with high pressure and/or other gasses (e.g., oxygen) by a system such as a supercharger or turbocharger. Alternatively, a gas source may be used to introduce gas into and/or pressurize the combustion chamber. For example, vehicle 100 may include an onboard pressurized source of one or more gasses (e.g., a pressurized bottle or other container storing oxygen and/or other gasses). The pressurized source may be controlled (e.g., by a control circuit, engine control module 213, control circuit 209, or other system) to selectively provide the gas to one or more combustion chambers through a valve (e.g., intake or exhaust valve), a dedicated injection port, fuel injector 203 and/or 205 (e.g., fuel injector 203 and/or 205 may include an annulus or other dedicated and separately controllable path for injecting gas separate from a path for fuel), or another delivery system.

In some embodiments, gas (e.g., air, oxygen, etc.) bubbles are formed by drawing dissolved air out of solution in the fuel. The gas content of the fuel stream may be enhanced prior to bubble formation by the dissolving of gas within the fuel stream or by other techniques. The gas may be dissolved with the fuel stream by one or more techniques including increasing the pressure and/or temperature of the gas and fuel stream.

In some embodiments, fuel droplets may be injected via fuel injector(s) 203 and/or 205 with oscillations in shape or spin. Oscillations in shape or spin may enhance the breakup, vaporization, and/or combustion of the fuel droplets. Fuel injector(s) 203 and/or 205 may include nozzles, valves, and/or other components which create oscillations in shape or spin in the injected fuel droplets. For example, nozzles may have shaped passageways which cause fuel droplets to exit the nozzle with rotation. A plurality of differently shaped passageways may create varying spin between different fuel droplets injected into cylinder(s) 217 and/or manifold 215.

In yet further embodiments, one or more of the above techniques may be combined or used in combination. In embodiments in which air and/or other gasses are injected into fuel droplets (e.g., using an annulus, using piezoelectric systems, etc.), the gas bubble internal to the fuel droplet may help in the breakup of the fuel droplet within the combustion chamber of engine 211 and/or the complete combustion of the fuel droplet. The fuel and gas mixture internal to the fuel droplet may combust, during the combustion cycle of engine 211, causing the fuel droplet to explode outward. This may reduce the formation of soot. Fuel droplets having a gas injected within the fuel droplet may have an improved surface area to volume ratio for the fuel. This may aid in complete combustion and/or the reduction of soot or other combustion byproducts.

Still referring to FIG. 2, in some embodiments fuel system 201 includes control circuit 209. Control circuit 209 may control the operation of one or more components of fuel system 201. For example, control circuit 209 may control the operation of fuel injectors 203 and/or 205, fuel pump 207, and/or other components. Control circuit 209 may communicate with other components of the vehicle. For example, control circuit 209 may communicate with engine control module (ECM) 213 of engine 211. Control circuit 209 may request and/or receive information or instructions from ECM 213. For example, control circuit 209 may receive information regarding one or more characteristics of engine 211 or related to engine 211 such as throttle position, engine rotation speed, engine timing, vale timing, engine temperature, piston position, current combustion cycle for one or more cylinders 217, and/or other information. Instructions provided by ECM 213 to control circuit 209 may include instructions to increase fuel pressure, inject more fuel, decrease fuel pressure, inject less fuel, alter the mix ratio of gas and fuel, and/or otherwise control one or more characteristics of the fuel or fuel and gas mixture delivered to engine 211. In alternative embodiments, the functions of control circuit 209 are carried out by ECM 213 or other control module of vehicle 100. In still further embodiments, control circuit 209 may be or be in communication with other control modules of vehicle 100.

Control circuit 209 may contain circuitry, hardware, and/or software for facilitating and/or performing the functions described herein. Control circuit 209 may handle inputs, process inputs, run programs, handle instructions, route information, control memory, control a processor, process data, generate outputs, communicate with other devices or hardware, and/or otherwise perform general or specific computing tasks. In some embodiments, control circuit 209 includes a processor. In some embodiments, control circuit 209 includes memory.

The processor may be implemented as a general-purpose processor, an application specific integrated circuit (ASIC), one or more field programmable gate arrays (FPGAs), a digital-signal-processor (DSP), a group of processing components, or other suitable electronic processing components. Memory is one or more devices (e.g. RAM, ROM, Flash Memory, hard disk storage, etc.) for storing data and/or computer code for facilitating the various processes described herein. Memory may be or include non-transient volatile memory or non-volatile memory. Memory may include database components, object code components, script components, or any other type of information structure for supporting various activities and information structures described herein. Memory may be communicably connected to the processor and provide computer code or instructions to the processor for executing the processes described herein.

Memory and/or control circuit 209 may facilitate the functions described herein using one or more programming techniques, data manipulation techniques, and/or processing techniques such as using algorithms, routines, lookup tables, arrays, searching, databases, comparisons, instructions, etc.

Fuel system 201 may include one or more fuel pumps 207. Fuel pump 207 may be any type of pump suitable for delivering fuel (e.g., a fuel stream) to one or more fuel injector 203 and/or fuel injector 205 from a fuel reservoir (e.g., fuel tank) located in vehicle 100. Fuel pump 207 may be controlled by control circuit 209 and/or ECM 213. In further embodiments, fuel pump 207 may be controlled by or based on input from one or more sensors included in fuel system 201 and/or fuel injectors 203 and/or 205.

ECM 213 may be any control circuit, processor, memory, and/or other control system for controlling one or more functions of engine 211. ECM 213 may control fuel system 201 and/or one or more individual components of fuel system 201. For example, ECM 213 may provide instructions to control circuit 209 and/or fuel injectors 203 and/or 205 which control the amount of fuel, mixture of fuel and gas, or other parameter of the fuel delivered to manifold 215 and/or cylinders 217.

ECM 213 may contain circuitry, hardware, and/or software for facilitating and/or performing the functions described herein. ECM 213 may process inputs, run programs, handle instructions, route information, control memory, control a processor, process data, generate outputs, communicate with other devices or hardware, and/or otherwise perform general or specific computing tasks. In some embodiments, ECM 213 includes a processor. In some embodiments, ECM 213 includes memory.

The processor may be implemented as a general-purpose processor, an application specific integrated circuit (ASIC), one or more field programmable gate arrays (FPGAs), a digital-signal-processor (DSP), a group of processing components, or other suitable electronic processing components. Memory is one or more devices (e.g. RAM, ROM, Flash Memory, hard disk storage, etc.) for storing data and/or computer code for facilitating the various processes described herein. Memory may be or include non-transient volatile memory or non-volatile memory. Memory may include database components, object code components, script components, or any other type of information structure for supporting various activities and information structures described herein. Memory may be communicably connected to the processor and provide computer code or instructions to the processor for executing the processes described herein.

Memory and/or ECM 213 may facilitate the functions described herein using one or more programming techniques, data manipulation techniques, and/or processing techniques such as using algorithms, routines, lookup tables, arrays, searching, databases, comparisons, instructions, etc.

Figure 3B:
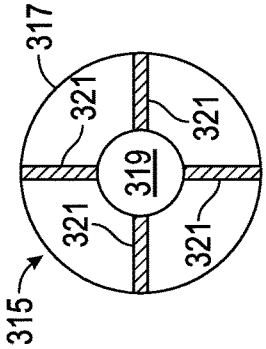
FIG. 3B is an illustration of an annulus valve seat for controlling the flow of gas within an annulus of a fuel injector according to one embodiment.
Figure 3C:
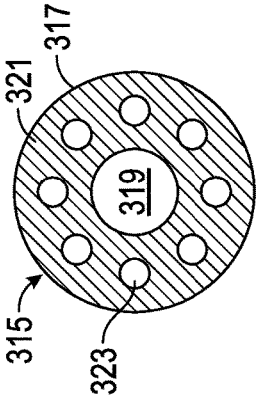
FIG. 3C is an illustration of an annulus valve seat for controlling the flow of gas within an annulus of a fuel injector according to one embodiment.
Figure 3A:
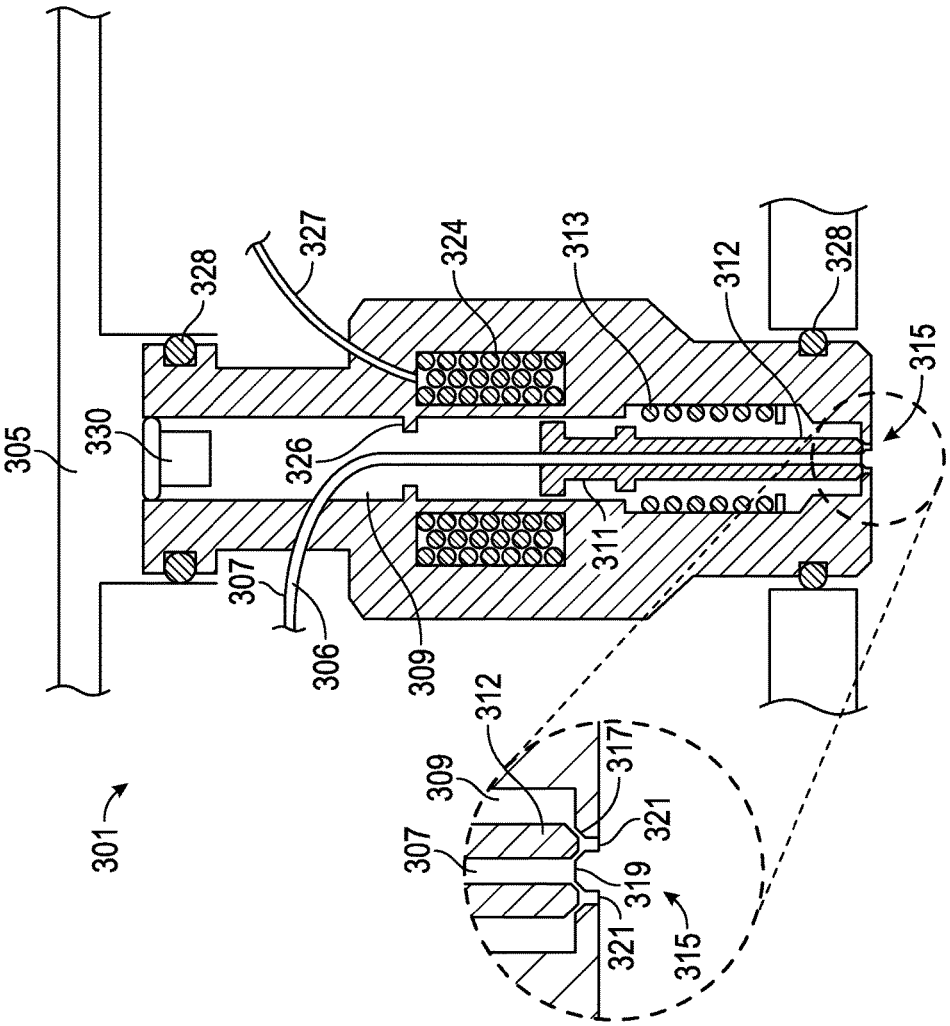
FIG. 3A is an illustration of a fuel injector having an annulus for providing a gas within a fuel stream according to one embodiment.

Referring now to FIG. 3A, a cross section of fuel injector 301 is illustrated according to one embodiment. Fuel injector 301 may be used as fuel injector 203 to inject fuel and/or fuel and gas mixture into intake manifold 215 of engine 211. Fuel injector 301 may be used as fuel injector 205 to inject fuel and/or fuel and gas mixture into cylinder 217 of engine 211. Fuel injector 301 is configured to inject air and/or other gasses into fuel passing through fuel injector 301. Fuel injector 301 may insert a high pressure gas-core into individual droplets. In some embodiments, fuel injector 301 creates a stream of fuel surrounding a core of air (and/or other gasses) which when broken into droplets creates droplets with cores of air (and/or other gasses). When combusted, these droplets may reduce or prevent the formation of soot and/or other combustion byproducts.

In some embodiments, fuel injector 301 includes annulus 307. Annulus 307 is a structure including valve stem 312 and/or running through valve stem 312. Annulus 307 creates a void 306 which acts as a pathway for gas to be injected into the fuel stream. Fuel path 309 flows around annulus 307 and/or valve stem 312. Thus, annulus 307 allows for gas to be provided within fuel injector 301 internal to fuel being provided by fuel injector 301 (e.g., through fuel path 309. Annulus 307 may also include other components. For example, annulus 307 may include a conduit (e.g., flexible, rigid, semi-rigid) or other structure which runs within and/or outside of fuel injector 301 to couple annulus 307 to a gas source. Thus, annulus 307 may be coupled to a gas source such that gas flows through void 306 through fuel injector 301 and internal to valve stem 312 and/or fuel path 309. The gas may flow through a conduit portion of annulus 307 which is not surrounded by fuel, fuel path 309, and/or valve stem 312. The gas may further flow through a portion of annulus 307 which is at least partially surrounded by fuel path 309 and/or fuel. The gas may further flow through a portion of annulus 307 which is internal to valve stem 312 around which fuel may flow through fuel path 309.

Annulus 307 runs through fuel injector 301 to deliver a gas to nozzle 315. Annulus 307 may be or include portions which are rigid, semi-rigid, and/or flexible. Annulus 307 connects (e.g., by a flexible or rigid house or conduit) to an air or gas source. The air or gas source may be a pump, compressor (e.g., supercharger, turbocharger, or other pump system suitable for compressing gas), pressurized tank, and/or other source of air or gas at a pressure sufficient to allow the air or gas to move through annulus 307. Annulus 307 may be telescoping and/or flexible to allow for movement towards and away from annulus valve seat 319. This may allow annulus 307 to seat and unseat from annulus valve seat 319 controlling the emission of gas provided through annulus 307.

In some embodiments, annulus 307 is a guide for magnet 311 and valve stem 312. Magnet 311 and valve stem 312 may travel along annulus 307 in order to open and close (e.g., unseat from and seat to valve seat 317 and/or annulus valve seat 319. Annulus 307 may include a rigid and/or fixed portion which serves as the guide for magnet 311 and valve stem 312. Annulus 307 may include a second telescoping or flexible portion which is entirely or partially within valve stem 312 and travels with magnet 311 and/or valve stem 312 toward and away from valve seat 317 and/or annulus valve seat 319.

In some embodiments, magnet 311 is guided by the geometry of fuel path 309 of fuel injector 301. Fuel path 309 may be a hollow section of fuel injector 301 which allows fuel to travel from fuel rail 305 to nozzle 315. Fuel path 309 may be sufficiently wide to allow fuel to pass around magnet 311 and also be sufficiently narrow to guide magnet 311 such that valve stem 312 seats with valve seat 317 when fuel injector 301 is in a closed configuration. In further alternative embodiments, magnet 311 and/or valve stem 312 are guided and/or positioned with supporting structures other than those pictured in FIG. 3A. These structures may guide magnet 311 and/or valve stem 312 to allow for the seating and unseating of valve stem 312 including annulus 307.

In some embodiments, valve stem 312, including annulus 307, is normally open. Spring 313 (e.g., a coil spring, flat spring, etc.), illustrated as a cross section, is configured to position valve stem 312 and annulus 307 away from valve seat 317 and annulus valve seat 319. Magnet 311 is used to close injector 301 by causing valve stem 312 to seat with valve seat 317 and annulus 307 to seat with annulus valve seat 319. Electromagnets 324 (e.g., coils of electrically conducting wire) may be supplied with electricity by lead 327. This causes the generation of a magnetic field which moves magnet 311 and valve stem 312, including annulus 307, into a closed position (e.g., seated with valve seat 317 and annulus valve seat 319). Electromagnet 324 is controlled by one or more of control circuit 209 and ECM 213. Control circuit 209 and/or ECM 213 may control the flow of electricity to electromagnet 324 via a switch located between lead 327 and a power supply. Magnet 311 may be further positioned by flange 326 which prevents magnet 311 and valve stem 312 coupled thereto from moving too far away from valve seat 317 and/or annulus valve seat 319. Flange 326 may be defined by the geometry of fuel path 309.

In alternative embodiments, valve stem 312 and/or annulus 307, or a portion thereof, is driven by mechanisms other than a solenoid (e.g., magnet 311, electromagnet 324, and spring 313). For example, valve stem 312 may be driven by a mechanical system, pneumatic system, camshaft, and/or other system for controlling repeated movements.

Fuel injector 301 may include other components such as fuel filter 330 and O-rings 328. Fuel filter 330 may filter fuel passing from fuel rail 305 into injector 301. O-rings 328 may seal fuel injector 301 to fuel rail 305, manifold 215, and/or cylinder 217.

Referring now to the detailed view of nozzle 315 provided in FIG. 3A, nozzle 315 is configured to include valve seat 317 and annulus valve seat 319. Valve seat 317 receives valve stem 312 to block the flow of fuel from fuel path 309 to nozzle 315. Annulus valve seat 319 receives annulus 307 to block the flow or air and/or other gasses (e.g., oxygen, nitrogen, nitrous oxide, a mixture of air and oxygen, etc.) from a pressurized source (e.g., a compressor, turbocharger, supercharger, pressurized tank, etc.) to nozzle 315. Valve stem 312 and annulus 307 included therein, or a telescoping portion of annulus 307, move towards and away from valve seat 317 and annulus valve seat 319 as the position of magnet 311 is controlled by the supply of electricity to electromagnet 324. When valve stem 312 and annulus 307 are unseated, fuel and an inner core of gas from annulus 307 are able to exit fuel injector 301 through nozzle 315.

Valve seat 317, annulus valve seat 319, valve stem 312, and/or annulus 307 are configured to allow for the seating and unseating of these features. For example, one or more of the components may be chamfered, radiused, have a knife edge, or otherwise be configured to seal and unseal.

Annulus valve seat 319 may be supported within nozzle 315 by one or more supports 321 which position annulus valve seat 319 and allow for flow of fuel and/or gas through nozzle 315 (e.g., around supports 321).

Referring now to FIG. 3B, a bottom view of nozzle 315 is illustrated according to one embodiment. Supports 321 extend from valve seat 317 to annulus valve seat 319. Fuel, gas (e.g., air, oxygen, etc.), a fuel stream with a gas core, and/or fuel droplets having a gas filled internal area may pass around supports 321 to exit fuel injector 301 through nozzle 315.

Referring now to FIG. 3C, a bottom view of nozzle 315 is illustrated according to one alternative embodiment, Support 321 extend from valve seat 317 to annulus valve seat 319. Support 321 includes one or more holes or nozzles 323. Fuel, gas (e.g., air, oxygen, etc.), a fuel stream with a gas core, and/or fuel droplets having a gas filled internal area may pass around support 321 through holes or nozzles 323 to exit fuel injector 301 through nozzle 315.

Referring generally to FIGS. 3A-3C, alternative configurations of fuel injector 301 may be used to provide fuel having an air or other gas core. Annulus 307 may be otherwise configured in order to provide a stream of gas within a fuel stream traveling through fuel injector 301. For example, annulus 307 may enter fuel injector 301 in valve stem 312 with a separate supporting structure guiding magnet 311 and/or valve stem 312. Annulus 307 entering at valve stem 312 may be telescoping, flexible, and/or otherwise configured to allow for annulus 307 to move with valve stem 312. In further alternative embodiments, air or other gasses may be injected into the fuel stream at nozzle 315. For example, nozzle 315 may include one or more outlets which are controlled to inject gas into the fuel droplets and/or fuel stream exiting fuel injector 301. Providing gas within a fuel stream, according to one or more embodiments discussed herein, may result in a stream of gas surrounded by an annulus of fuel. The breakup of the fuel surrounded air, for example caused by nozzle 315, results in droplets of fuel with gas from annulus 307 trapped inside.

Figure 3D:
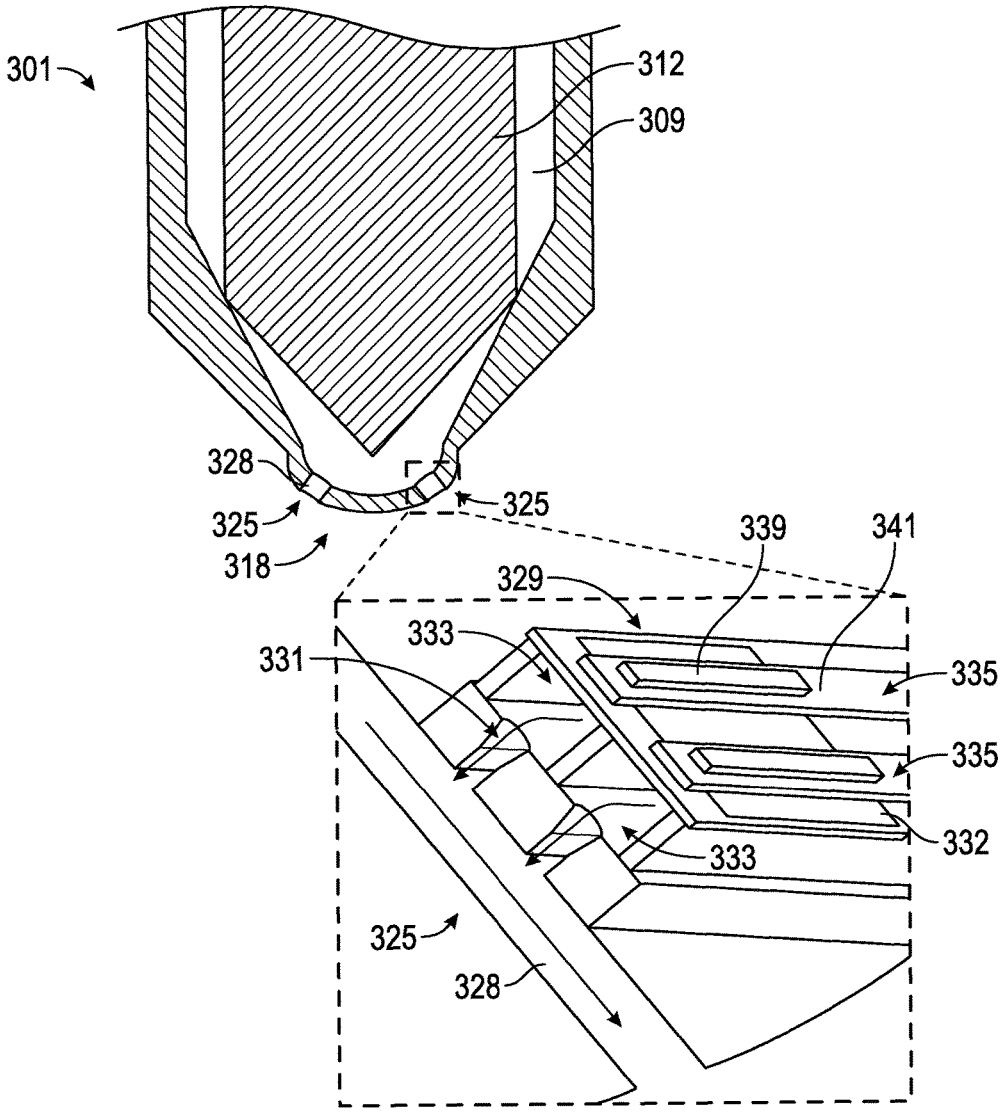
FIG. 3D is an illustration of a fuel injector having a piezoelectric driver for providing a gas within a fuel stream of the fuel injector according to one embodiment.

Referring now to FIG. 3D, fuel injector 301 is illustrated according to one embodiment to include piezoelectric driver 329. Fuel injector 301 may be used as fuel injector 203 to inject fuel and/or fuel and gas mixture into intake manifold 215 of engine 211. Fuel injector 301 may be used as fuel injector 205 to inject fuel and/or fuel and gas mixture into cylinder 217 of engine 211. Fuel injector 301 is configured to inject air and/or other gasses into fuel passing through fuel injector 301. Fuel injector 301 may insert a high pressure gas-core into individual droplets. When combusted, these droplets may reduce or prevent the formation of soot and/or other combustion byproducts.

Fuel injector 301 may include valve stem 312 which seats and unseats from valve seat 317 of fuel injector 301 due to the geometry of fuel path 309 and motion of valve stem 312. Valve stem 312 may be moved using a solenoid (e.g., magnet 311, electromagnet 324, and spring 313), a mechanical system, pneumatic system, camshaft, and/or other system for controlling movement. The system providing motive force to valve stem 312 may be controlled by control circuit 209 and/or ECM 213. When valve stem 312 is seated against the body of injector 301 (e.g., valve seat 317), fuel path 309 is blocked and fuel is unable to exit fuel injector 301 via nozzle 315 and holes 325 thereof. When valve stem 312 is unseated, fuel is able to pass valve stem 312 in fuel path 309 and enter nozzle 315 and holes 325 thereof.

Holes 325 of nozzle 315 may be used to break up a fuel stream into fuel droplets and/or smaller fuel streams. Nozzle 315 may have any number of holes 325 (e.g., one, two, four, 12, etc.). Holes 325 provide path 328 from fuel injector 301 through nozzle 315 and into manifold 215, cylinder 217, or other combustion chamber of engine 211.

Referring now to the detailed view provided in FIG. 3D, one or more holes 325 include one or more piezoelectric drivers 329 configured to inject air bubbles into a fuel stream and/or individual fuel droplets. The fuel stream in which piezoelectric driver 329 injects air bubbles may be broken up into fuel droplets containing air and/or other gasses as the fuel stream exits hole 325 and nozzle 315. The stream exiting the confined space of hole 325 (e.g., path 328) may breakup naturally due to the increased volume into which the stream is entering and/or the velocity of the fuel stream. Alternatively, piezoelectric driver 329 may inject air or other gasses into the fuel stream during the breakup of the fuel stream into droplets. For example, piezoelectric driver 329 may be positioned at the exit of hole 325 such that air and/or other gasses are injected as the fuel stream begins to breakup due to exiting from hole 325.

Piezoelectric driver 329 uses piezoelectric element(s) 335 to drive flexible portion 337 of reservoirs 333 in order to inject a gas held in reservoirs 333 through nozzles 331 and into the fuel stream and/or fuel droplets passing through hole 325 via path 328. Nozzles 331 may be funneled or shaped to receive gas from reservoir 333. In some embodiments, the reduced cross section of nozzle 331 increases the pressure and/or flow rate of gas from reservoir 333 into path 328. In some embodiments, the opening of nozzles 331 are flush with path 328. In alternative embodiments, nozzles 331 extend within path 328 to facilitate the injection of gas into the fuel stream and/or one or more fuel droplets.

Gas enters nozzle 331 from reservoir 333. Reservoir 333 is configured to receive and contain one or more gasses from one or more gas sources prior to the gas being driven out of reservoir 333 by the action of piezoelectric element 335. Reservoir 333 may be maintained at a pressure such that the gas contained therein does not transfer into the fuel stream within path 328. For example, reservoir 333 may store the gas at a pressure lower than that of hole 325 and/or the fuel stream contained therein. Mechanical action from piezoelectric element(s) 335 may increase the pressure within reservoir 333 such that the gas or gasses are forced into the fuel stream and/or individual fuel droplets via nozzle 331.

In some embodiments, reservoir 333 receives one or more gasses from a gas source. Reservoir 333 may be connected to the gas source by one or more conduits, pipes, pressure regulators, and/or other components. The connection to the gas source allows gas to flow into reservoir 333 at the appropriate pressure (e.g., pressure sufficient to drive the gas into reservoir 333 but low enough that the gas does not exit reservoir 333 through nozzle 331). The gas source may be atmospheric. In other words, reservoir 333 may draw or receive air from the atmosphere surrounding fuel injector 301 and/or a conduit extending from fuel injector 301 which is open to atmosphere. The gas source may be a source of compressed air and/or other gasses (e.g., oxygen, nitrogen, nitrous oxide). For example, the gas source may be a pressurized tank, super charger, turbocharger, or other container or system.

Reservoir 333 may be or include several sections separated by vertical portions. Alternatively, piezoelectric driver 329 may include a plurality of reservoirs separated by wall portions. Each reservoir 333 may correspond to an individual nozzle 331. In alternative embodiments, each reservoir 333 may have a plurality of nozzles 331 (e.g., a plurality of nozzles 331 running along the depth of reservoir 333).

Piezoelectric driver 329 may further include one or more flexible portions 337 forming a part of reservoir 333 (e.g., the top portion). Flexible portion(s) 337 may function as a diaphragm which when driven by piezoelectric element 335 reduces and/or expands the volume of reservoir 333. In some embodiments, each reservoir 333 or segment of reservoir 333 is capped with a separate flexible portion 337. In alternative embodiments, a single flexible portion 337 extends to cap a plurality of reservoirs 333 or portions of reservoir 333.

Piezoelectric driver 329 includes one or more piezoelectric elements 335 which when provided with electricity cause flexible portion 337 to deform and reduce the volume of reservoir 333. Piezoelectric elements 335 may be controlled and/or driven by electricity controlled and provided by control circuit 209 and/or ECM 213. Control circuit 209 and/or ECM 213 may time the activation of piezoelectric elements 335 such that gas is injected by piezoelectric driver 329 when fuel is present due to the activation of fuel injector 301 (e.g., valve stem 312 is unseated and fuel flows through fuel injector 301).

In some embodiments, piezoelectric elements 335 include upper electrode 339 and lower electrode 341. Control of electricity to electrodes 339 and 341 causes piezoelectric element 335 to deform. Piezoelectric element 335 and/or electrodes 339 and/or 341 may be made of or include one or more piezoelectric materials. For example, piezoelectric element 335 may be or include quartz, lanthanum gallium silicate, and/or other piezoelectric materials.

Referring further to FIGS. 3A-3D, one or more elements or features of fuel injector 301 described herein may be combined in some embodiments. For example, fuel injector 301 may include both an annulus 307 and piezoelectric driver 329 for creating fuel droplets having an internal gas fill. In some embodiment's, nozzle 315 may include both holes 325 and annulus valve seat 319. Other combinations of components and characteristics are possible in various embodiments. Any component described herein may be combined with any other component according to various embodiments.

Figure 3E:
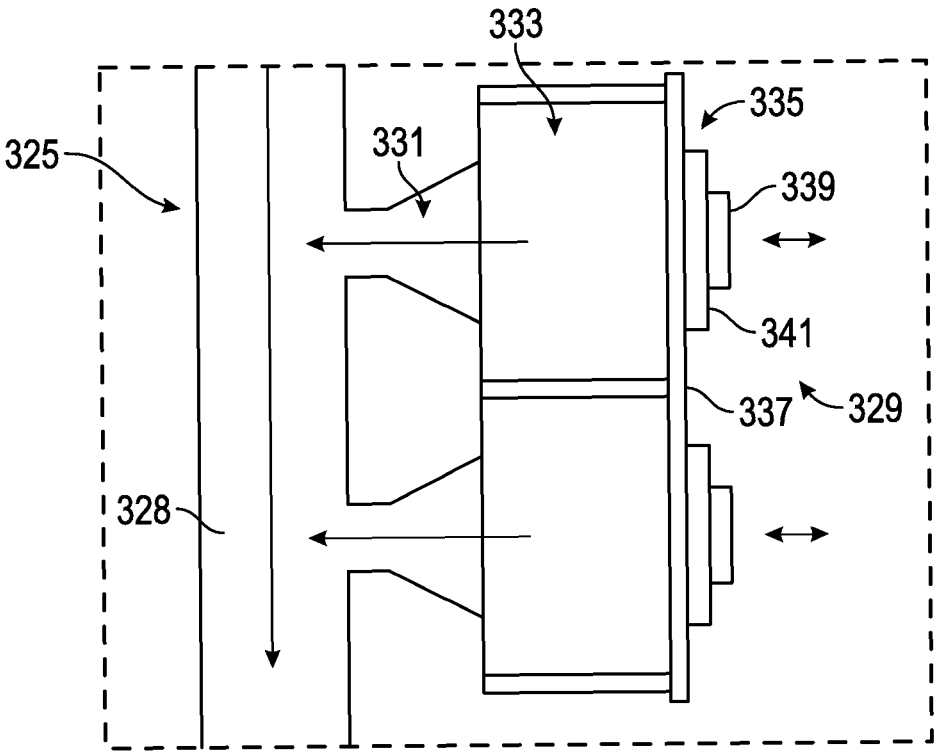
FIG. 3E is a profile view illustration of a fuel injector having a piezoelectric driver for providing a gas within a fuel stream of the fuel injector according to one embodiment.

Referring now to FIG. 3E, a profile view of piezoelectric driver 329 is illustrated according to one embodiment. Piezoelectric elements 335 may drive flexible portion 337. Flexible portion 337 may from one side of reservoir 333. When flexible portion 337 is deformed by motion of piezoelectric driver 335, the volume of reservoir 333 is decreased. This may cause gas within reservoir 333 to exit reservoir 333 through nozzle 331. The gas exiting nozzle 331 may be injected into fuel or a fuel stream in path 328. Path 328 may be a path through which fuel flows and may be located within hole 325 of nozzle 315 of fuel injector 301.

Figure 4A:
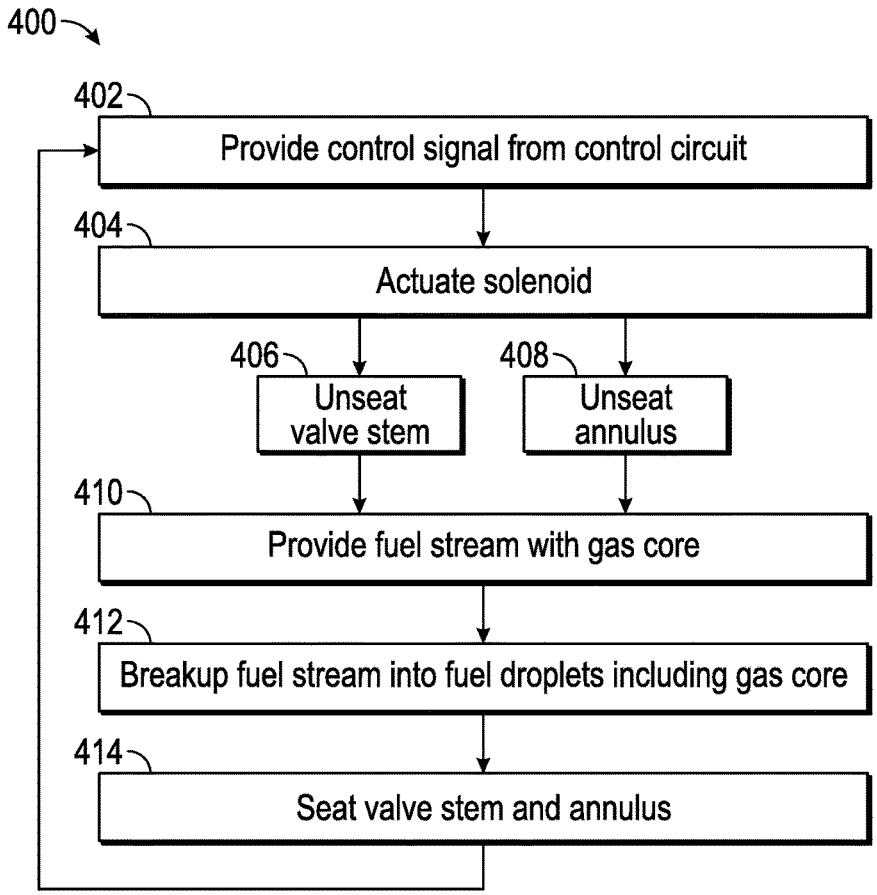
FIG. 4A is a flow chart illustrating the operation of a fuel injector, including an annulus for providing gas to a fuel stream, according to one embodiment.

Referring now to FIG. 4A, method 400 for operating engine 211 with gas injected fuel is illustrated according to one embodiment. A control signal for controlling fuel injector(s) 203 and/or 205 is provided (402). In some embodiments, the control signal is provided by control circuit 209. In alternative embodiments, the control signal is provided by ECM 213. The control signal may cause fuel injector(s) 203 and/or 205 to provide fuel to engine 211, cease providing fuel to engine 211, provide a specific amount of fuel, provide a specific mixture of fuel and other gasses (e.g., air, oxygen, etc.), and/or otherwise control the operation of fuel injector(s) 203 and/or 205.

The solenoid (e.g., magnet 311, electromagnet 324, and spring 313) of fuel injector 203 and/or 205 actuates (404). A solenoid controlling the movement of valve stem 312 and/or annulus 307 may be controlled in response to the control signal (e.g., from control circuit 209 and/or ECM 213). For example, control circuit 209 may provide a control signal which causes, directly or indirectly, electrical energy to be provided to electromagnet 324 via lead 327. Electromagnet 324 may create a magnetic field which moves magnet 311 and compresses spring 313. Valve stem 312 and/or annulus 307 may be positioned by the movement of magnet 311.

Valve stem 312 may be unseated (406) and/or annulus 307 are unseated (408). Valve stem 312 may be unseated from valve seat 317 simultaneously with annulus 307 being unseated from annulus valve seat 319. In alternative embodiments, valve stem 312 and annulus 307 are unseated at different times. Valve stem 312 and/or annulus 307 may be unseated from valve seat 317 and/or annulus valve seat 319 in response to actuation of the solenoid as the movement of magnet 311 causes movement of valve stem 312 and/or annulus 307 away from valve seat 317 and/or annulus valve seat 319. The solenoid may be normally closed as thus described. In alternative embodiments, the solenoid may be normally open, in which case, actuation of the solenoid may seat valve stem 312 and/or annulus 307 with valve seat 317 and/or annulus valve seat 319.

A fuel stream passing through fuel injector(s) 203 and/or 205 is provided with a gas core (410). Gas may exit from annulus 307 into a surrounding column of fuel passing around annulus 307 in fuel path 309. This may create a fuel stream which has a core of gas. In some embodiments, the gas is air. In alternative embodiments, the gas may be one or more or air, oxygen, oxygen enriched air, nitrous oxide, and/or other gasses.

The fuel stream is broken up into fuel droplets including gas cores (412). In some embodiments, the fuel stream containing a gas core is broken into fuel droplets containing a gas core due to the fuel stream exiting nozzle 315. The expanded volume into which the fuel stream is ejected (e.g., cylinder 217 or other combustion chamber, manifold 215, etc.), the geometry of nozzle 315, and/or the velocity of the fuel stream may cause the fuel stream to break into droplets and/or aerosolize. In alternative embodiments, the injection of the gas from annulus 307 into the fuel stream in fuel path 309 causes the fuel stream to break into droplets containing gas cores. For example, the gas flow from annulus 307 may have a velocity, volume, and/or other characteristic which causes the fuel stream to break into droplets containing gas cores. In further embodiments, the flow of gas from annulus 307 into the fuel stream may be separately controlled (e.g., turned on and off) from the flow of fuel passing through fuel injector 203 and/or 205 in order to create gas filled fuel droplets. For example, the flow of gas from annulus 307 may be rapidly turned on and off via a valve controlled by control circuit 209 and/or ECM 213 which valve stem 312 is unseated in order to create gas filled fuel droplets.

Valve stem 312 and/or annulus 307 are seated (414). Valve stem 312 be seated against valve seat 317. This may stop of the flow of fuel and/or fuel and gas mixture from fuel injector(s) 203 and/or 205. Annulus 307 may be seated against annulus valve seat 319. This may stop the flow of gas from annulus 307. In some embodiments, valve stem 312 and/or annulus 307 are seated in response to a control signal from control circuit 209 and/or ECM 213. The control signal may cause electromagnet 324 to become un-energized (e.g., the control signal causes electricity to stop being provided to electromagnet 324). Magnet 311 may be returned to its original position by the operation of spring 313. In alternative embodiments, control circuit 209 and/or ECM 213 may cease providing a control signal and/or electricity via lead 327, which causes electromagnet 324 to become un-energized. In alternative embodiments, the solenoid is normally open. In this case, control circuit 209 and/or ECM 213 provides a control signal which directly or indirectly energizes electromagnet 324 moving magnet 311. This may cause valve stem 312 and/or annulus 307 to be moved and seated against valve seat 317 and/or annulus valve seat 319. The steps of method 400 may repeat or otherwise be iterative.

Figure 4B:
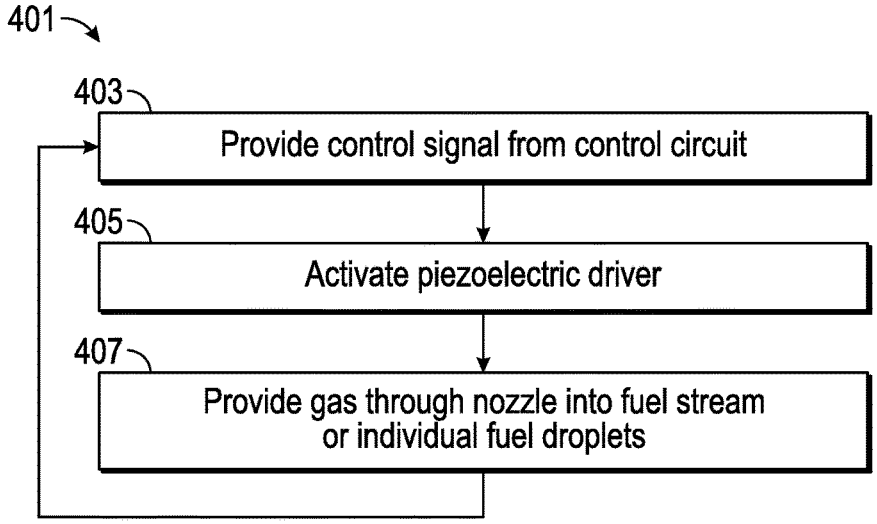
FIG. 4B is a flow chart illustrating the operation of a fuel injector, including a piezoelectric driver for providing gas to a fuel stream, according to one embodiment.

Referring now to FIG. 4B, method 401 for operating engine 211 with gas injected fuel is illustrated according to one embodiment. A control signal is provided to fuel injector(s) 203 and/or 205 (403). The control signal may be provided by control circuit 209 and/or ECM 213. The control signal may be formatted and/or include information configured to activate a piezoelectric device for injecting gas into the fuel stream and/or fuel droplets in fuel injector(s) 203 and/or 205. In some embodiments, the control signal includes instructions, includes information, and/or is otherwise formatted to control the operation of the piezoelectric device such that the amount of gas provided, content of gas provided, type of gas provided, velocity of gas provided, and/or other characteristics of the gas provided by the piezoelectric device are controlled according to the control circuit.

The piezoelectric device is activated (405). In some embodiments, the piezoelectric device is piezoelectric driver 329 as described with reference to FIG. 3D. In alternative embodiments, the piezoelectric device is another type or configuration of piezoelectric elements for providing a gas to the fuel stream and/or injecting a gas into fuel droplets. The piezoelectric device may be activated in response to the control signal provided.

The piezoelectric device provides gas through a nozzle and into the fuel stream or fuel droplets (e.g., injected into individual fuel droplets) (407). For example, the control signal provided by control circuit 209 may cause piezoelectric driver 329 to activate one or more piezoelectric elements 335. The piezoelectric elements 335 may cause flexible portion 337 to deform as piezoelectric elements 335 are energized. This may reduce the volume of reservoir(s) 333, causing a gas or mixture of gasses to exit reservoir 333 through nozzles 331. The gas may enter path 328 and the fuel stream therein. Additionally or alternatively, the gas or gas mixture may exit nozzle(s) 331 and enter fuel droplets. Method 401 may repeat and/or be iterative.

Figure 5:
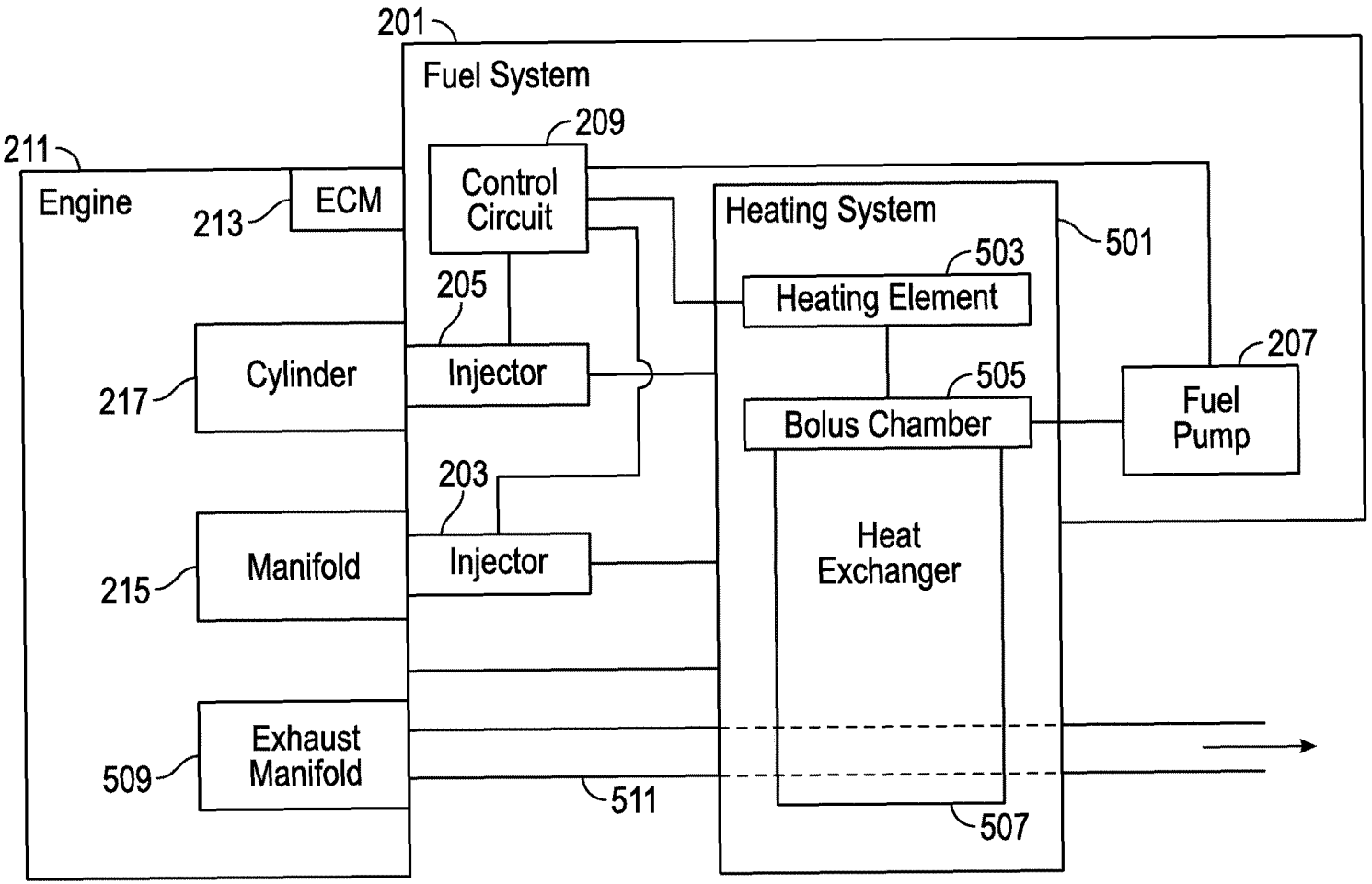
FIG. 5 is an illustration of a fuel injection system for heating fuel prior to injection according to one embodiment.

Referring now to FIG. 5, fuel system 201 and engine 211 are illustrated according to one embodiment in which heating system 501 is used to gasify the fuel provided to engine 211. Fuel (e.g., diesel, petrol, etc.) may be gasified such that the fuel and/or fuel air mixture provided to engine 211 includes only or substantially only fuel in a gas state. The fuel entering manifold 215 and/or cylinders 217 may include no or substantially no liquid fuel. Fuel may be extensively pre-heated prior to injection by fuel injector(s) 203 and/or 205. In some embodiments, fuel is heated using one or more heat sources such as heating element 503. In further embodiments, fuel is heated partially or entirely with heat scavenged from the exhaust of engine 211.

In some embodiments, the fuel provided to the combustion chamber(s) of engine 211, either directly using fuel injector(s) 203 or indirectly using fuel injector(s) 205, is entirely or substantially in a gas state. Fuel-aerosols (e.g., liquid fuel sprayed from a nozzle of an injector) are not used to provide fuel to engine 211. Injecting gasified fuel into the combustion chamber of engine 211 may prevent or substantially prevent small-carbonaceous-particle formation as may occur with the use of fuel in a liquid state.

In some embodiments, liquid fuel is not allowed to enter cylinder 217 and/or other combustion chambers of engine 211. Liquid fuels within engine combustion chambers typically burn-down to sub-micron carbonaceous particles resulting from incomplete combustion of fuel. Liquid fuel particles typically have too much heat capacity relative to the fuel dense surroundings (e.g., surrounding fuel droplets in liquid injection systems) in order for the liquid fuel particles to evaporate completely or substantially completely prior to combustion. The remaining liquid fuel particles typically surface-ablate and coke-down to soot and/or other combustion byproducts. By eliminating or substantially eliminating unevaporated (e.g., liquid state) fuel from the combustion chamber at the time of combustion, fuel system 201 may prevent or substantially prevent the formation of soot or combustion byproducts formed as a result of surface-ablation of liquid fuel particles. As previously described, fuel system 201 may achieve the complete or substantially complete evaporation and/or combustion of fuel by delivering fuel droplets with a gas core, delivering fuel into a pressurized combustion chamber, and/or using other techniques described with reference to FIG. 2. In additional or alternative embodiments, fuel system 201 achieves this result by pre-heating the fuel prior to delivery to engine 211.

Fuel system 201 may heat all or substantially all fuel components to above their boiling points under ambient pressure conditions (e.g., approximately one atmosphere). In some embodiments, fuel and/or fuel components may be heated to well above their boiling points. The fuel and/or fuel components may be in a vapor state before they significantly combust. Heating under low pressure conditions (e.g., without artificial pressurization) may prevent auto-ignition and/or combustion of the fuel prior to its delivery to the combustion chamber of engine 211.

In some embodiments, heating of the fuel occurs just as fuel is injected into cylinder(s) 217 and/or manifold 215. For example, injector(s) 203 and/or injector(s) 205 may include one or more heating elements 503. Heating element(s) 503 may be used to heat fuel prior to injection (e.g., heat fuel to a vapor or gas state prior to injection). In some embodiments, fuel is heated prior to injection. Fuel may be heated to a vapor or gas state prior to injection by injector(s) 203 and/or injector(s) 205. Heating may occur remote from injector(s) 203 and/or injector(s) 205. For example, fuel may be heated by exhaust gasses and heat exchanger 507 and/or by heating element 503 remote from injector(s) 203 and/or 205. A fuel bolus may be heated prior to injection in bolus chamber 505. Bolus chamber 505 may be located remote from fuel injector(s) 203 and/or 205. Alternatively, bolus chamber 505 may a chamber or volume located near or incorporated in one or more fuel injector(s) 203 and/or 205. In some embodiments, fuel may be heated in bolus chamber 505 under pressure in order to maintain the fuel in a liquid state. This may facilitate the transfer of heated fuel from bolus chamber 505 to fuel injector(s) 203 and/or 205 for delivery to engine 211 (e.g., heated fuel in liquid state may be pumped). Fuel injector(s) 203 and/or 205 may include an expansion chamber or other mechanism to reduce the pressure of the heated fuel. This may allow the fuel to vaporize prior to injection into the combustion chamber(s) of engine 211.

Still referring to FIG. 5, in some embodiments heating system 501 is located remotely from fuel injector(s) 203 and/or 205. Heating system 501 may include one or more heating elements 503. Heating elements 503 may be any source of heat configured to heat fuel stored within vehicle 100. For example, heating element 503 may be an electric heat source such as a resistance heater. In further embodiments, heating element 503 may be other sources of heat such as infrared heater(s), chemical heaters, and/or other heaters.

Heating element 503 may heat fuel directly through contact with the fuel itself. For example, heating element 503 may be located within a conduit, bolus chamber 505, or other container storing and/or transporting fuel. In alternative embodiments, heating element 503 heats fuel through a heat exchanger or other intermediate system.

In some embodiments, heating system 501 includes bolus chamber 505. Bolus chamber 505 may store fuel prior to injection by fuel injector(s) 203 and/or 205. Bolus chamber may receive fuel from a fuel tank of vehicle 100 via fuel pump 207. Bolus chamber 505 may store fuel while it is heated by heating element(s) 503. Heating element(s) 503 may be located within bolus chamber 505, provide heat to fuel within bolus chamber 505 via a heat exchanger extending within bolus chamber 505, heat bolus chamber 505 itself (e.g., through conduction), and/or otherwise directly or indirectly heat fuel within bolus chamber 505.

Bolus chamber 505 may store heated fuel and/or heat fuel under pressure to maintain the fuel in liquid state while at elevated temperature. Bolus chamber 505 may be pressurized by controlling the outflow of fuel (e.g., with a valve) and receiving fuel via fuel pump 207. In other words, fuel pump 207 may cause bolus chamber 505 to become pressurized. In alternative embodiments, bolus chamber 505 may be pressurized using one or more other techniques in place or in addition to pressurization by fuel pump 207. For example, bolus chamber 505 may include an additional pump for pressurizing bolus chamber 505, bolus chamber 505 may receive air and/or other gasses from a pressurized source (e.g., super charger, turbocharger, pressurized gas tank) for use in pressuring bolus chamber 505, and/or other techniques may be used to pressurize bolus chamber 505.

In embodiments where bolus chamber 505 contains heated and pressurized fuel, bolus chamber 505 delivers heated fuel in a liquid state to fuel injector(s) 203 and/or 205. Fuel injector(s) 203 and/or 205 may be configured to deliver the heated fuel into the combustion chamber and/or manifold 215 in a liquid state. For example, fuel injector(s) 203 and/or 205 may maintain the fuel under pressure to prevent a state change from liquid to gas. The fuel may vaporize due to the heat and depressurization associated with entering the larger volume of the combustion chamber and/or manifold 215. Alternatively, fuel injector(s) 203 and/or 205 may include an expansion chamber, pressure relief system, and/or other mechanism by which the fuel is vaporized prior to entering the combustion chamber of engine 211.

In alternative embodiments, bolus chamber 505 contains heated fuel in a gas state and/or heats fuel under non-pressurized conditions (e.g., approximately one atmosphere of pressure, increases in pressure caused only by the state change of the fuel from liquid to gas, etc.). In embodiments where bolus chamber 505 contains heated fuel in a gas state, bolus chamber 505 delivers fuel to fuel injector(s) 203 and/or 205 in a gas state. Fuel injector(s) 203 and/or 205 may be configured to deliver fuel and/or a fuel and gas mixture to the combustion chamber (e.g., cylinder 217) and/or manifold 215 in a gas state. For example, fuel injector(s) 203 and/or 205 may include seals, plungers, and/or other components rated for use with gas.

In some embodiments, heating system 501 includes heat exchanger 507 configured to heat fuel using heat scavenged from exhaust gasses from engine 211. In some embodiments, heat exchanger 507 receives heat from one or more exhaust pipes 511. Exhaust pipe 511 extends from exhaust manifold 509 and transfers exhaust gasses away from engine 211. Heat exchanger 507 transfers heat from heat exhaust gasses to bolus chamber 505 in some embodiments. In other embodiments, heat exchanger 507 transfers heat from exhaust gasses to fuel contained in other portions of fuel system 201 (e.g., a conduit or pipe extending from fuel pump 207 to injector(s) 203 and/or 205). Heat exchanger 507 may include a working fluid and/or pump with the working fluid circulating between heat sinks (e.g., plates, coils, etc.) located in or around exhaust pipe 511 and heat sinks (e.g., plates, coils, etc.) located in or around the fuel to be heated (e.g., in or around bolus chamber 505, a conduit containing fuel, etc.).

In alternative embodiments, heat exchanger 507 is located partially in or around exhaust manifold 509. For example, heat exchanger 507 may include one or more heat sink elements (e.g., plates, coils, etc.) which extend within exhaust manifold 509 in order to scavenge heat from exhaust gasses in exhaust manifold 509. In still further alternative embodiments, heat exchanger may scavenge heat from other sources associated with engine 211. In one such embodiment, heat exchanger 507 scavenges heat from the block (e.g., engine block) of engine 211. Heat exchanger 507 may include heat sink elements which extend within the block and/or are in contact with the block. For example, heat exchanger 507 may include pipes, plates, or channels within the engine block. In still further embodiments, heat exchanger 507 may receive heat from a cooling system of vehicle 100. For example, coolant used to cool engine 211 may pass through heat exchanger 507 prior to passing through a radiator or other components of the cooling system of vehicle 100.

In some embodiments, heating system 501 includes only a subset of the components described herein. For example, heating system 501 may include heating element(s) 503 but not include heat exchanger(s) 507 for scavenging heat from exhaust gasses from engine 211. In other embodiments, heating system 501 includes heat exchanger(s) 507 for scavenging heat from exhaust gasses for use in heating the fuel but does not include heating element(s) 503.

Still referring to FIG. 5, in alternative embodiments, heating system 501 is integrated with fuel injector(s) 203 and/or 205. One or more heating elements 503 may be located in, on, or near fuel injector(s) 203 and/or 205. For example, a portion or the entirety of heating element 503 may extend within fuel injector(s) 203 and/or 205 to heat the fuel. In alternative embodiments, heating element(s) 503 may be placed upstream of fuel injector(s) 203 and/or 205 in or around a conduit, a fuel rail, or other component which delivers fuel to fuel injector(s) 203 and/or 205. Heat exchanger 507 may be configured to heat fuel in, at, and/or near fuel injector(s) 203 and/or 205 using heat scavenged from exhaust gasses of engine 211. Heat transfer elements (e.g., coils, plates, channels, etc.) of heat exchanger 507 may extend within, surround, or otherwise be positioned to transfer heat to fuel in fuel injector(s) 203 and/or 205 and/or fuel in conduit or other piping which leads to fuel injector(s) 203 and/or 205.

In some embodiments, one or more components of heating system 501 are controlled by control circuit 209 and/or ECM 213. For example, control circuit 209 may control valves which control the flow of fuel into and/or out of bolus chamber 505. Control circuit 209 may control one or more heating elements 503. For example, control circuit 209 may turn heating element(s) 503 on or off, control the amount of heat provided by heating element(s) 503, and/or otherwise control the operation of heating element(s) 503. Control circuit 209 may control heat exchanger 507. For example, control circuit 209 may control valves, pumps, and/or other components of heat exchanger 507 which affect or control the transfer of heat from exhaust gasses to fuel. Control circuit 209 may control pumps and valves which in turn control the flow rate, volume, and/or other parameters of a working fluid within heat exchanger 507. In alternative embodiments, heat exchanger 507 is a passive system not controlled by control circuit 209.

Figure 6:
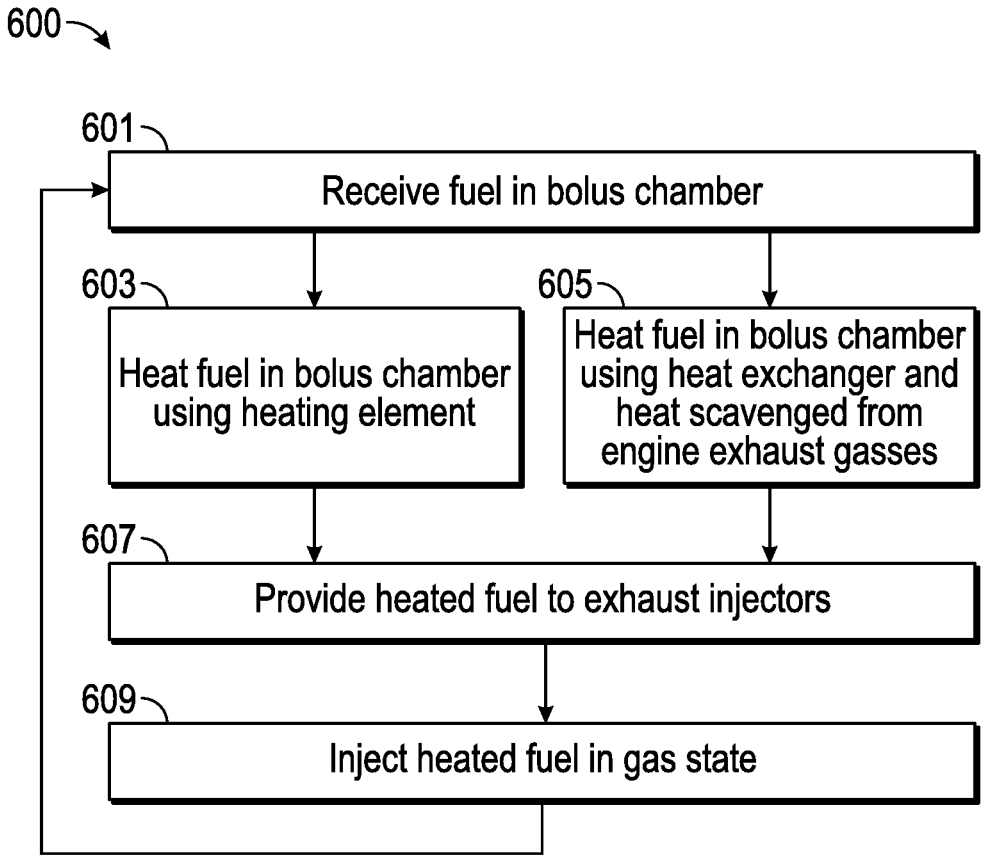
FIG. 6 is a flow chart illustrating the operation of a fuel injection system for heating fuel prior to injection according to one embodiment.

Referring now to FIG. 6, method 600 for providing gas state fuel to engine 211 is illustrated according to one embodiment. Fuel is received in bolus chamber 505 (601). In some embodiments, fuel is received in bolus chamber 505 from fuel pump 207. The fuel may be in a liquid state. Control circuit 209 and/or ECM 213 may control the amount of fuel provided to and/or received by bolus chamber 505. For example, control circuit 209 and/or ECM 213 may control fuel pump 207 to provide a specific amount of fuel and/or rate of fuel sent to bolus chamber 505 and/or control one or more valves of bolus chamber 505 to control the amount of fuel received in bolus chamber 505.

In some embodiments, the fuel within bolus chamber 505 is heated by one or more heating elements 503 (603). In some embodiments, the fuel within bolus chamber 505 is heated by heat exchanger 507 using heat scavenged from exhaust gasses. Fuel in bolus chamber 505 may be heated simultaneously by both heat sources. Alternatively, fuel is bolus chamber 505 may be heated at separate times by different heat sources (e.g., alternating, one and then the other, one first and continuously with the other source starting later and then heating concurrently, etc.). In alternative embodiments, fuel in bolus chamber 505 is heated by only one of heating element(s) 503 or heat exchanger(s) 507. The fuel in bolus chamber 505 may be heated to a gas state, heated but remain in a liquid state, heated under pressure in order to maintain the fuel in a liquid state, and/or be heated to different temperatures, states, or under different conditions.

The heated fuel is provided to fuel injector(s) 203 and/or 205 (607). In some embodiments, the fuel provided to fuel injector(s) 203 and/or 205 is in a gas state. The fuel may be at a pressure greater than ambient air pressure in bolus chamber 505 due to the transition from liquid to gas state. The fuel may be at a greater pressure in gas state than in the previous liquid state while contained in bolus chamber 505. This pressure may provide the fuel to fuel injector(s) 203 and/or 205. In some embodiments, bolus chamber 505 may include one or more valves which control the flow of fuel (e.g., in gas or liquid state) from bolus chamber 505 to fuel injector(s) 203 and/or 205. In further embodiments, the heated fuel (e.g., in gas or liquid state) may be provided to fuel injector(s) 203 and/or 205 from bolus chamber 505 using a pump (e.g., pump or compressor) and/or as a result of increased pressure or displacement caused by additional fuel entering bolus chamber 505 from fuel pump 207. Pumps, compressors, valves, and/or other components of or associated with bolus chamber 505 may be controlled by control circuit 209 and/or ECM 213 to provide heated fuel to fuel injector(s) 203 and/or 205. Control circuit 209 and/or ECM 213 may control these and/or other components (e.g., heat exchanger 507 and/or heating element(s) 503) to provide fuel to fuel injector(s) 203 and/or 205 at a specific temperature, volume, flow rate, state, and/or with other specific characteristics.

In alternative embodiments, the heated fuel is provided to fuel injector(s) 203 and/or 205 in a liquid state. Fuel injector(s) 203 and/or 205 may cause the fuel to transition to a gas state before, after, or simultaneously with injecting the fuel. For example, fuel injector(s) 203 and/or 205 may include heating element(s) 503 and/or heat exchanger(s) 507 which further heat the fuel to a gas state. Alternatively, fuel injector(s) 203 and/or 205 may include a chamber (e.g., bolus chamber 505) or expansion chamber which allows the pressurized and heated liquid fuel to expand and transition to a gas state due to the decrease in pressure.

Fuel injector(s) 203 and/or 205 inject the heated fuel or otherwise resulting fuel in a gas state (607). Fuel injector(s) 203 and/or 205 may be controlled by control circuit 209 and/or ECM 213 to inject fuel in a gas state. The fuel may be injected into cylinder(s) 217, manifold 215, other types of combustion chambers (e.g., a combustion chamber in a Wankel engine), and/or at other locations. Method 600 may repeat and/or be iterative.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media may be any available media that may be accessed by a general purpose or special purpose computer or other machine with a processor. By way of example, such machine-readable media may comprise RAM, ROM, EPROM, EEPROM, CD-ROM or other optical disk storage, magnetic disk storage or other magnetic storage devices, or any other medium which may be used to carry or store desired program code in the form of machine-executable instructions or data structures and which may be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A fuel injector for an engine, comprising:

a connection configured to receive fuel from a fuel source;

a nozzle configured to provide an outlet for the fuel from the fuel injector;

a fuel path extending from the fuel source to the nozzle;

a valve between the fuel source and the nozzle configured to selectively block the flow of fuel within the fuel path; and a gas injection mechanism configured to inject a gas core into the fuel at a location along the fuel path, wherein the gas injection mechanism is an annulus within a valve stem included in the valve.

2. The fuel injector of claim 1, wherein the gas injection mechanism is coupled to a gas source, and wherein the gas source is at least one of a turbocharger, a supercharger, or a pressurized tank.

3. The fuel injector of claim 1, wherein the annulus receives gas from a gas source and provides the gas into a fuel stream of the fuel passing around the annulus in the fuel path, wherein the annulus creates a fuel stream of the fuel with a gas core when the fuel injector is injecting fuel.

4. The fuel injector of claim 1, wherein the gas injection mechanism includes a piezoelectric driver.

5. The fuel injector of claim 4, wherein the piezoelectric driver comprises:

a piezoelectric element coupled to a flexible portion configured to deform when the piezoelectric element is energized, wherein the flexible portion forms a top portion of a reservoir containing gas; and a second nozzle coupled to the reservoir;

wherein energizing the piezoelectric element causes the flexible portion to deform, thereby decreasing the volume of the reservoir and driving gas through the second nozzle, wherein the gas is injected as a gas core into the fuel.

6. The fuel injector of claim 4, wherein the piezoelectric driver is configured to inject gas bubbles into a fuel stream of the fuel enclosed in the fuel path, and wherein the fuel stream is separated into fuel droplets between the gas bubbles by the nozzle.

7. The fuel injector of claim 4, wherein the piezoelectric driver is configured to inject gas bubbles into a fuel stream of the fuel during a breakup of the fuel stream into fuel droplets.

8. The fuel injector of claim 1, wherein the nozzle includes one or more holes configured to break up a fuel stream of the fuel exiting the nozzle into individual fuel droplets including gas cores.

9. The fuel injector of claim 1, wherein the valve includes a valve stem and a valve seat, wherein the valve seat includes an annulus valve seat shaped to receive an annulus within the valve stem, and wherein the annulus defines a path from a gas source to the fuel injector.

10. The fuel injector of claim 1, wherein the fuel injector is positioned to inject fuel and gas into a combustion chamber of the engine.

11. The fuel injector of claim 1, wherein the fuel injector is positioned to inject fuel and gas into a cylinder of the engine.

12. The fuel injector of claim 1, wherein the fuel injector is positioned to inject fuel and gas into an intake manifold of the engine.

13. A fuel injector for an engine, comprising:

a connection configured to receive fuel from a fuel source;

a nozzle configured to provide an outlet for the fuel from the fuel injector;

a fuel path extending from the fuel source to the nozzle;

a valve stem shaped to engage a valve seat to control the flow of fuel through the fuel path; and an annulus within the valve stem and coupled to a gas source; wherein the annulus is configured to provide gas to a core of a fuel stream of the fuel, in the fuel path, flowing around the valve stem, wherein the valve stem is coupled to a solenoid configured to position the valve stem relative to the valve seat.

14. The fuel injector of claim 13, wherein the annulus receives gas from the gas source and provides the gas into the fuel stream of the fuel, wherein the annulus creates a gas core within the fuel stream when the fuel injector is injecting fuel.

15. The fuel injector of claim 13, wherein the annulus is configured to engage with an annulus valve seat to control the flow of the gas from the gas source to the core of the fuel stream in the fuel path, and wherein the annulus is coupled to the solenoid such that the solenoid positions the annulus relative to the annulus valve seat.

16. The fuel injector of claim 13, wherein the flow of gas from the annulus is controlled by a valve and a control circuit, and wherein the control circuit controls the solenoid.

17. The fuel injector of claim 13, wherein the nozzle includes an annulus valve seat configured to receive the annulus and control the flow of gas from the annulus, wherein the annulus valve seat is coupled to the nozzle with one or more supports, and wherein the fuel path passes around or through the supports.

18. The fuel injector of claim 13, further comprising a control circuit configured to control the fuel injector, wherein the control circuit controls the annulus to fill a combustion chamber with high pressure gas before the solenoid injects fuel with a gas core into the combustion chamber.

19. The fuel injector of claim 13, further comprising a control circuit configured to control the fuel injector, wherein the control circuit controls the gas source to fill a combustion chamber with high pressure gas, and not using the annulus, before the solenoid injects fuel with a gas core into the combustion chamber.

20. The fuel injector of claim 13, wherein the fuel injector is positioned to inject fuel and gas into a combustion chamber of the engine.

21. The fuel injector of claim 13, wherein the fuel injector is positioned to inject fuel and gas into a cylinder of the engine.

22. The fuel injector of claim 13, wherein the fuel injector is positioned to inject fuel and gas into an intake manifold of the engine.

23. A fuel injector for an engine, comprising:

a connection configured to receive fuel from a fuel source;

a nozzle configured to provide an outlet for the fuel from the fuel injector;

a fuel path extending from the fuel source to the nozzle;

a valve stem shaped to engage a valve seat to control the flow of fuel through the fuel path, wherein the valve stem is coupled to a solenoid configured to position the valve stem relative to the valve seat; and a piezoelectric driver configured to inject a gas from a gas source into a fuel stream of the fuel.

24. The fuel injector of claim 23, wherein the piezoelectric driver includes:

a piezoelectric element coupled to a flexible portion configured to deform when the piezoelectric element is energized; the flexible portion forming a top portion of a reservoir configured to contain gas; and a second nozzle coupled to the reservoir;

wherein energizing the piezoelectric element causes the flexible portion to deform decreasing the volume of the reservoir and driving gas through the second nozzle, wherein the gas is inserted as a gas core into the fuel.

25. The fuel injector of claim 23, wherein operation of the piezoelectric driver is timed by a control circuit to cause injection of gas by the piezoelectric driver only when the fuel stream is present.

26. The fuel injector of claim 23, wherein the piezoelectric driver injects the gas into the fuel stream such that the gas mixes with the fuel stream.

27. The fuel injector of claim 23, wherein the piezoelectric driver injects the gas into the fuel stream to form a gas core within the fuel stream of the fuel.

28. The fuel injector of claim 23, wherein the piezoelectric driver injects the gas into individual fuel droplets.

29. The fuel injector of claim 23, wherein a second nozzle of the piezoelectric driver is positioned to inject gas into the fuel stream in a hole of the nozzle of the fuel injector.

30. The fuel injector of claim 23, wherein a second nozzle of the piezoelectric driver is positioned to inject gas into the fuel stream upstream of the valve stem.

31. The fuel injector of claim 23, wherein a second nozzle of the piezoelectric driver is positioned to inject gas into the fuel stream downstream of the valve stem.

32. The fuel injector of claim 23, wherein the piezoelectric driver is included in the valve stem, and wherein a second nozzle of the piezoelectric driver is positioned to inject gas into the fuel stream flowing around the valve stem in the fuel path.

33. The fuel injector of claim 23, wherein the nozzle includes one or more holes configured to break up a fuel stream of the fuel exiting the nozzle into individual fuel droplets including gas cores.

34. The fuel injector of claim 23, wherein the gas and the fuel are injected into a combustion chamber filled with a high pressure second gas.

* * * * *